US005722558A

United States Patent [19]

Thompson

[11] Patent Number: 5,722,558

[45] Date of Patent: Mar. 3, 1998

[54] DRINK LID WITH CONDIMENT RESERVOIR

[75] Inventor: Troy N. Thompson, Lexington, Ky.

[73] Assignee: Sadler Inventions, Inc., Lexington, Ky.

[21] Appl. No.: 832,088

[22] Filed: Apr. 3, 1997

[51] Int. Cl.[6] ..... B65D 1/24

[52] U.S. Cl. ..... 220/521; 220/23.86; 220/212; 220/709; 220/781; 206/217; 206/501; 206/541

[58] Field of Search ..... 220/4.27, 521, 220/780, 781, 784, 796, 709, 212, 23.83, 23.86; 206/501, 217, 541; 229/906.1

[56] References Cited

U.S. PATENT DOCUMENTS

| | | | |
|---|---|---|---|
| D. 370,412 | 6/1996 | Rohrer . | |
| D. 376,311 | 12/1996 | Burton . | |
| 3,598,271 | 8/1971 | Holley . | |
| 4,503,992 | 3/1985 | Sitko et al. . | |
| 4,627,537 | 12/1986 | Rogers | 206/501 |
| 4,735,337 | 4/1988 | Von Holdt . | |
| 5,090,584 | 2/1992 | Roberts et al. . | |
| 5,366,089 | 11/1994 | Parker . | |
| 5,415,312 | 5/1995 | Mueller . | |
| 5,417,364 | 5/1995 | Shaw . | |
| 5,540,333 | 7/1996 | Gonzalez et al. . | |

*Primary Examiner*—Stephen Cronin
*Attorney, Agent, or Firm*—King & Schickli

[57] ABSTRACT

A container lid, adapted for use with a cold or hot drink, is provided with a condiment reservoir built into the lid. An orifice for drinking a liquid in the container is provided on one side of a planar surface forming the lid and an open top recess, forming the condiment reservoir, is provided on the other side. Closed side walls and a bottom extending down toward the container serve to form the reservoir. The condiment can be carried directly in the reservoir or in a condiment holder, such as a packet or cup, placed in the reservoir. The side walls extend at an acute angle from the planar surface to allow multiple lids to nest together prior to use. A mating groove and annular projection in the recess and on a cup, respectively, serves as a snap fit interlock system to hold the cup in place. The side walls of the recess include a semicircular wall and a diagonal wall connecting the ends to form the reservoir. Alternatively, the recess can be various shapes, including cylindrical, rectangular or multiple recesses connected together, as well as various sizes. If desired, the recess can be deep enough so that the reservoir is positioned in ice when a cold drink fills the container.

14 Claims, 2 Drawing Sheets

DRINK LID WITH CONDIMENT RESERVOIR

TECHNICAL FIELD

This invention relates generally to lids for disposable containers, and more particularly to a new and improved lid with a reservoir for carrying condiments or condiment holders for convenient use.

BACKGROUND OF THE INVENTION

The increased popularity of fast food establishments, coupled with the popularity for consumption of food even while traveling has led to the need for more convenient carrying of condiments for use with various food products. Examples of such condiment use include the use of ketchup with french fries, or the use of various sauces with finger foods, such as chicken strips or nuggets.

Currently, condiments are distributed for such single use in sealed plastic packets, some of which are foil lined. In other fast food establishments, the condiments are dispensed into disposable paper or plastic cups from pumps or the like. Both the packets and the cups are well-suited for use in the restaurant setting or at other stationary locations, such as on a table or other surface.

However, when traveling in a moving vehicle, use of these prior art condiment packets/cups is troublesome. In addition to the difficulty in tearing open condiment packets while traveling, both the driver and passengers are left without a secure place to hold the condiment while the finger food is dipped into it.

Many vehicles come equipped with can or cup holders that are generally cylindrical in shape, however these holders are considerably larger than the standard packet or condiment cup. There is simply no suitable flat surface for placement of these condiment packets/cups. Even in vehicles with flat interior surfaces, no provision is made for holding them in place on the surface. Thus, the constant back and forth and lateral motion of the vehicle during travel, inevitably allows the condiment packets/cups to move about. In addition to being distracting to the driver and annoying to the passengers, the motion of the condiment cups creates the potential for spillage.

Previously, others have attempted to meet the need for carrying condiments for dipping of the food product while riding in a vehicle. In one proposal, a piggy back container arrangement, that is open-topped for easy access is provided. The primary container holds the food product, and a secondary container is attached to the side of the primary container for carrying the condiment. For example, in U.S. Pat. No. 5,540,333 to Gonzalez et al., a large bag is provided for the french fries and a secondary bag hung on the side of the primary bag is provided for the ketchup. Although the '333 patent overcomes the prior basic difficulty of carrying the condiment with the food product, this arrangement has serious limitations. For example, securely holding the combined bag in the vehicle for use remains a difficult task, as there is generally no suitable location for holding it without the likelihood of spilling the contents. Placement in any makeshift position, such as between the seats, simply is not stable enough, especially in a situation of a rapid acceleration, panic stop or sudden emergency swerve of the vehicle. Similar piggy back bag or carton arrangements are shown in Design Patents 376,311 to Burton and 370,412 to Rohrer, and in U.S. Pat. No. 5,417,364 to Shaw.

In addition to an improved arrangement for carrying condiments for use in a vehicle or other non-stationary environment, it is also desirable to control the temperature of the condiment while it is being used. Most consumers prefer to have the condiment chilled, or at least not warm, when it is being consumed with a warm finger food. For example, with french fries most taste tests find that the warm fries taste better when dipped in cooler ketchup. The prior art concepts, including the piggy back arrangements, fail to recognize this point. Indeed, when the condiment container is hung on the side of the food product container, there is even an undesirable warming of the condiment. Thus, there is a need in the art for an improvement in carrying a condiment in a convenient, yet secure manner for use in conjunction with a food product in an unstable environment, such as a vehicle, and to keep the condiment at a desirable temperature for use.

BRIEF DESCRIPTION OF THE INVENTION

Thus, with the above needs for improvement in focus, it is a primary object of the present invention to provide a container lid for a drink container wherein a condiment can be easily accessed for use and held in a stable position, such as when traveling in a vehicle.

It is still another object of the present invention to provide a recess of various configurations in a container lid that can be utilized for carrying a condiment for convenient use, either directly in a recessed reservoir or by placement of a packet or cup in the reservoir.

It is still another object of the present invention to provide a container lid that allows for drinking of a liquid from the container but also provides an open top recess to form a reservoir for a condiment.

Another related object of the present invention is to provide a container lid that allows for carrying condiment such that the temperature of the condiment is maintained at a desirable temperature for use.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved container lid is provided with an open top recess that serves as a condiment reservoir. The lid is defined by a planar surface with an outer rim for attachment to the open top of a container, such as a disposable cold drink container that is standard at fast food restaurants and the like. An orifice for drinking of a liquid from the container extends through the planar surface of the lid on one side and adjacent the outer rim of the lid that serves to hold the lid secure on the container.

The reservoir is preferably positioned opposite the orifice and extends down toward the container. It will be realized that the container once it is securely positioned in the cup holder of the vehicle, or securely positioned in another non-stationary environment, provides a way in which the condiment can be used in a very convenient manner.

The recess forming the reservoir is formed by side walls and a bottom that are closed, that is fully sealed throughout its full surface area, and extend at least partially into the container. The side walls are at an acute angle from the planar surface to the bottom to allow multiple lids to nest together prior to use.

According to another feature of the invention, the condiment can be placed directly in the reservoir, or a separate condiment holder, such as a packet or cup, can be used. According to the broadest aspects of the invention, the condiment can be used by dipping of finger food pieces, such as in the case of french fries and ketchup, or the condiment may be poured into the drink container, such as with cream being added to coffee.

The lid is formed of thin plastic, such as in a conventional vacuum forming process. Preferably, the recess includes a peripheral interlock around the side walls adjacent the bottom wall that mates with an interlock on a condiment cup. In the preferred embodiment, the interlock in the recess takes the form of a peripheral groove and the interlock on the mating condiment cup is a peripheral projection adjacent the bottom. The projection snaps into the groove as the side walls flex outwardly when the cup is pushed downwardly into position. The interlock action assures that the cup is held secure, even under the most severe outside forces that can be experienced while traveling in a vehicle, such as rapid acceleration or deceleration forces.

In a preferred embodiment of the invention, the side walls are formed by a substantially semi-circular wall and a diagonal wall connecting the ends of the semi-circular wall to form the reservoir. Alternative embodiments of the reservoir include a cylindrical recess, multiple semi-circular recesses interconnected through an open space, and a rectangular recess. Of course, other equivalent configurations falling within the principles of the present invention will be clear to others skilled in the art. For example, a simple rectangular shaped recess can be sized to initially accommodate two or more full condiment packets, the contents of which would then be placed in the recess as a reservoir for use in dipping of the french fries or other finger food.

When a cold drink is being consumed, it is contemplated that the depth of the recess is sufficient to cause the reservoir to be positioned in ice when the container is full. This serves the purpose of providing an additional advantage of cooling the condiment before use, such as when ketchup is provided in the reservoir for dipping of french fries, or other finger food. Further, it is contemplated that the cylindrical recess can be utilized to carry a single condiment container, such as a cup of cream for mating with a coffee cup. In another embodiment, multiple reservoirs can be formed, such as three semi-circular recesses in a triangle or clover leaf pattern. This lid would be particularly adapted for use with chicken strips or nuggets for holding one or more hot mustard, sweet & sour sauce and barbecue sauce. In each instance, the fill level of the drink container is adjusted to match the desired temperature control.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BEST MODE OF CARRYING OUT THE INVENTION

Figure 1:
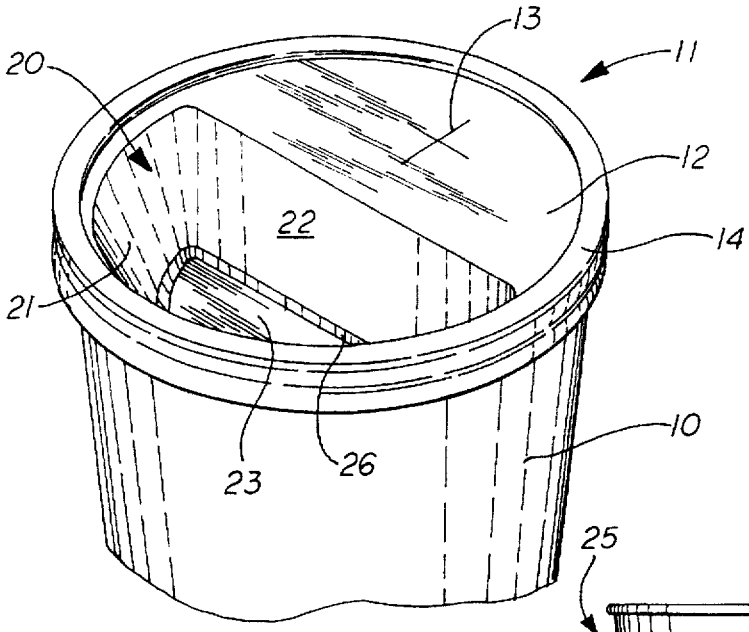
FIG. 1 is a perspective view of a preferred embodiment of a container lid, with the lid including a recess forming a condiment reservoir and covering the open top of a drink container, which is shown only partially.

Reference is now made to FIG. 1 of the drawings, illustrating a container 10 for a cold drink or the like and a container lid, generally designated by the reference numeral 11 and having features in accordance with the present invention. A planar surface 12 forms one portion of the upper surface of the lid, and which includes an orifice 13. In this particular embodiment, the orifice is formed by cross slits into which a straw can be inserted for drinking. An outer rim 14 extends around the planar surface 12 and when pushed down onto the upper edge of the container 10 provides for secure attachment, and thus a stable platform when the container 10 is placed in a vehicle cup holder or the like (not shown).

Formed into the planar surface 12 is a recess, generally designated by the reference numeral 20, forming the condiment reservoir and constituting an important feature of the present invention. The preferred embodiment of the recess 20 comprises closed side walls, including semi-circular wall 21 extending around adjacent the rim 14 on the side of the lid opposite the drinking orifice 13 and a diagonal wall 22 connected to the ends of the wall 21 (see FIG. 1*a*). The side walls 21, 22 connect to a closed bottom 23 to complete the recess.

As will now be realized, the recess 20 provides a reservoir for a condiment that is held on the top of the drink for easy access by the user. The container 10 can be securely positioned in the cup holder of a vehicle, or the like, and thus provide a solution to secure placement for use with finger foods, which has been a problem in the past. In the instance where french fries are being consumed, the condiment in the reservoir can be used for dipping. There is no longer a need to deal with trying to find a suitable, secure location for carrying the condiment holder in a vehicle.

Figure 2:
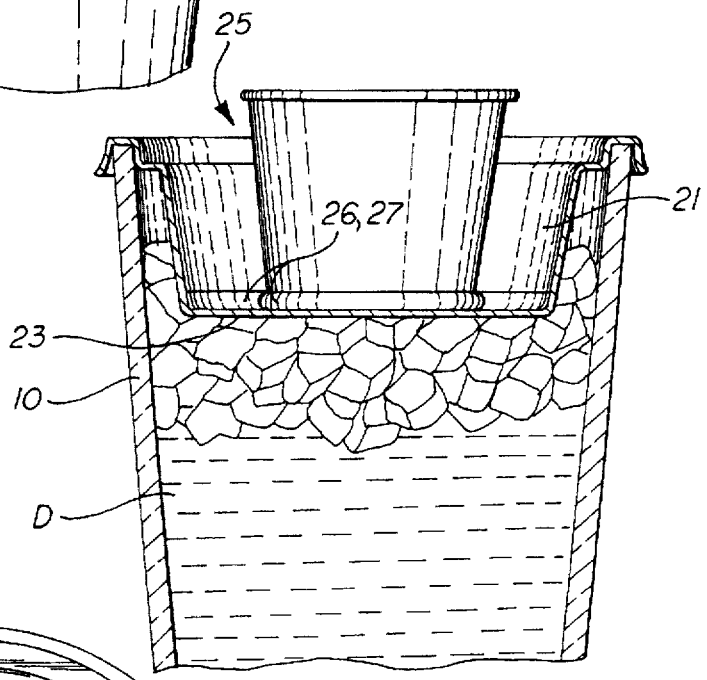
FIG. 2 is a partial cross sectional view of the container with the lid of FIG. 1 in position, an alternative condiment holder (cup) snapped in position in the recess and with the drink container holding a cold drink with ice floating on top.

As illustrated in FIG. 2, in the instance where a cold drink D is being served in the container 10, the preferred embodiment of the recess is at a depth where it extends down into the ice floating on the top when full. In this way, the condiment, such as ketchup, is slightly chilled, or is at least maintained at a lower temperature than the fries, as preferred by most consumers. The dipping of the fries in the condiment can occur at the same time that the drink D is being consumed by a straw (not shown) through the orifice 13.

The side walls 21, 22 extend at an acute angle from the planar surface 12 down toward the bottom 23 as illustrated best in FIG. 2. This angle is sufficient to allow multiple lids to nest together prior to use. Preferably, the lid is vacuum formed of thin plastic, and formed in various sizes to fit different size containers 10.

Figure 1A:
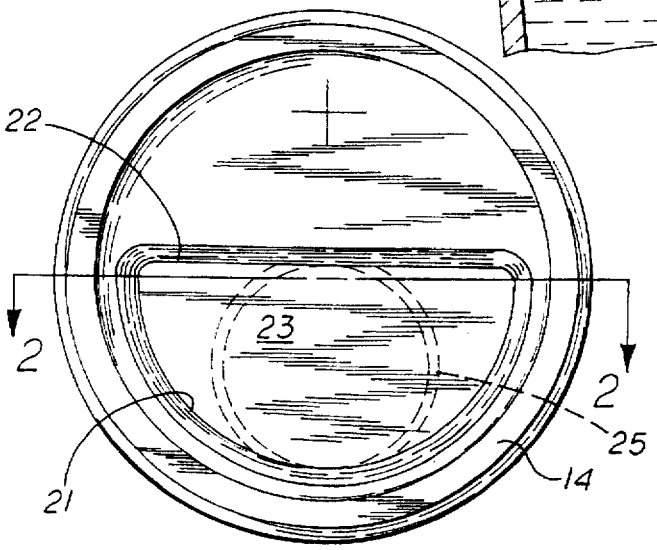
FIG. 1*a* is a top plan view of the container lid.

As another feature of the present invention, the recess 20 can be used for receiving a separate condiment holder, such as a condiment cup 25 used in some fast food restaurants (see also the dashed line outline of FIG. 1*a*). The width of the recess 20, that is between the midpoint of the semi-circular side wall 20 and the center of the diagonal side wall 22 is selected to exactly fit the width of such a standard condiment cup 25 (see the dashed line outline of FIG. 1*a*).

As indicated above, the lid is made of thin, vacuum formed plastic and, in accordance with one feature of the invention the plastic is sufficiently thin to allow outward flexing of the side walls as the cup 25 is positioned for use. Furthermore, mating interlocks can be used on the recess 20/cup 25 to further assure retention during use. The first interlock is formed in the recess 20 adjacent the bottom 23 and takes the form of a peripheral groove 26 into which the second interlock or peripheral projection 27 on the bottom of the cup mates (see FIGS. 1 and 2). During use, as the cup is pushed down in the recess for use, the side walls 21, 22 flex outwardly under the pressure of the peripheral projection 27 and when the bottom 23 is reached, the projection 27 is in alignment with the adjacent sections of the groove 26 and engages in a snap fit. Advantageously, in this arrangement while the cup is being used, it is held securely in place without the fear of inadvertent movement or tipping over.

Figure 2A:
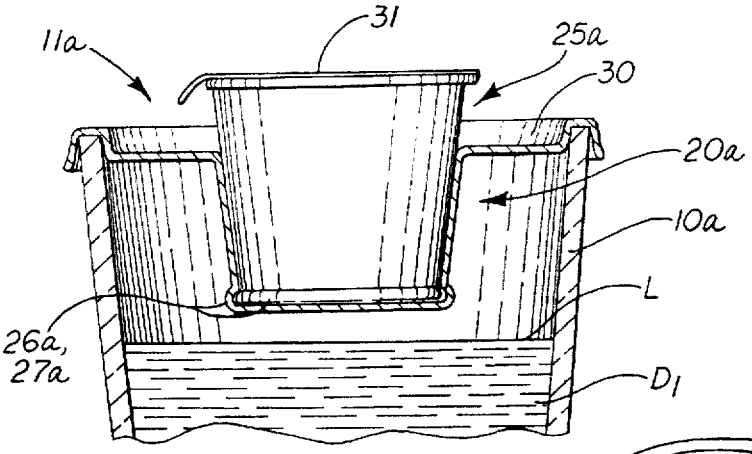
FIG. 2*a* demonstrates the use of a single cup embodiment, and in particular on a coffee container, and with an alternative full drink level to provide isolation where necessary.

An alternative embodiment of the container lid is shown in FIG. 2*a*. In this instance the container 10*a* can be filled with a hot drink $D_1$, for example coffee, and the condiment can be cream held in the cup 25*a*. In the illustration, the fill level L is held below the bottom of the recess 25*a*, so that the condiment is not subject to warming. Of course, before drinking, the cup is lifted, the sealed cover 31 removed and the contents poured into the container 10*a*. The creamed coffee can then be consumed through an orifice formed by a flap 30 on one side of the lid 11*a*.

It is a feature that the cup 25*a* snaps into position in a recess 20*a*, as shown. That is, the recess 20*a* includes a mating peripheral recess 26*a* and peripheral projection 27*a*, as described with regard to the embodiment of FIGS. 1, 1*a* and 2. Once the hot drink $D_1$ is ready to be consumed, the cup 25*a* is removed by snapping it out of the recess 20*a* the cover 31 removed, and the condiment poured into the container 10*a* either through the orifice formed by the tab 30 or by temporarily removing the lid 11*a*. The use with a hot drink in addition to the use with a cold drink, demonstrates the versatility of the lid of the present invention.

Figure 3:
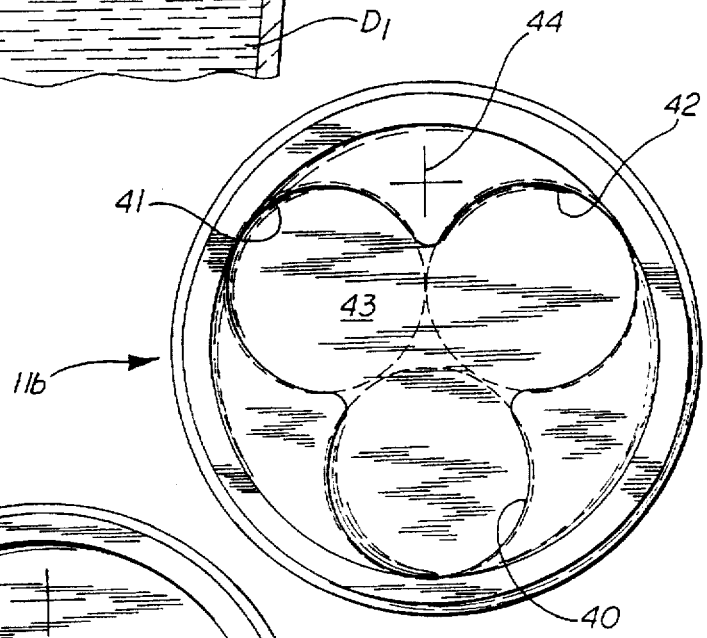
FIG. 3 is a top view of a multiple reservoir embodiment, and particularly adapted for holding a single, two or three difference condiments.

The top view of the lid 11*b*, as shown in FIG. 3, provides further evidence of the versatility of the present invention. In this instance, semi-circular side walls, 40, 41, 42 and bottom 43 are provided forming multiple recesses. These side walls 40–42 merge together in the center forming a common open space. An orifice 44 is provided opposite the recesses for drinking the cold drink in the container upon which the lid 11*b* is to be used. As illustrated, an efficient arrangement of this embodiment takes the form of three reservoirs in a triangular or clover leaf pattern. A popular use for this lid 11*b* is for carrying three different sauces for chicken strips or nuggets, such as hot mustard, sweet & sour sauce and barbecue sauce.

Figure 4:
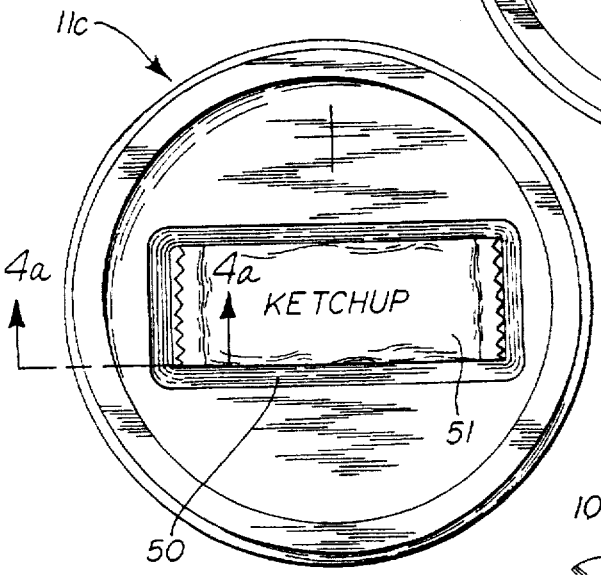
FIG. 4 is a top view of still another embodiment of the invention with the recess forming a relatively shallow reservoir, but sufficient to carry two single service condiment packets.
Figure 4A:
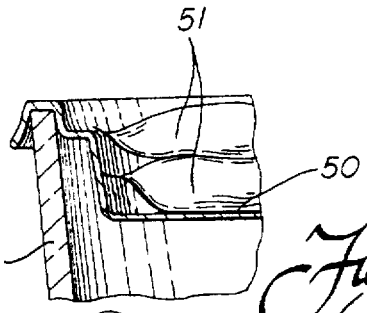
FIG. 4*a* is a partial cross sectional view taken along line 4*a*—4*a* of FIG. 4 illustrating the manner in which condiment packets are initially served with the drink.
Figure 4B:
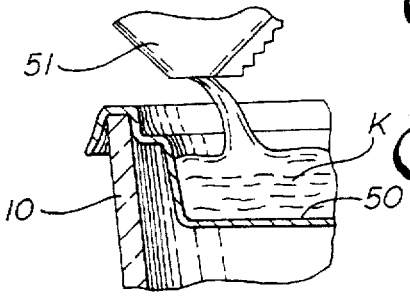
FIG. 4*b* is a similar partial cross-sectional view showing the manner in which the condiment, such as ketchup, is provided directly in the reservoir for use after breaking open and squeezing the packets.

In FIG. 4, a top view of still another embodiment is illustrated. This lid 11*c* is characterized by a shallow rectangular recess 50 and can be sized to receive a couple of condiment packets 51, for example. Thus, the consumer has a place to put the packets 51 when initially obtaining the drink, as illustrated in FIG. 4*a*, and then when it is time to eat, the condiment, such as ketchup K, can be placed in the reservoir formed by the recess 50, as illustrated in FIG. 4*b*.

In summary, it will be realized that the results and advantages of the present invention provide a solution to the problem of carrying condiments for use, such as ketchup for french fries, in an environment where stability is important, such as when traveling in a vehicle. Once the container 10 is securely positioned in the cup holder of the vehicle, the condiment is in a convenient location for easy dipping of the fries. At the same time, consuming the drink D in the container 10 through the orifice 13 is not in any manner hampered. The selected depth of the recess 20 forming the condiment reservoir can be sufficient to extend down into the container for chilling by the ice when the drink is first served (see FIG. 2). The level of the drink is controlled as desired, such as where a hot drink D, is involved (FIG. 2*a*). The condiment can be placed directly into the recess, or in the alternative a condiment packet or cup may be used. The cup 25, 25*a* snaps into the reservoir by the mating peripheral groove and projection 26, 27 or 26*a*, 27*a* forming an interlock system for additional stability and security. The several alternative embodiments illustrate the versatility of the container lid 11, 11*a*, 11*b* and 11*c* of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, if desired the condiment may be prepackaged directly in the reservoir rather than being initially in a packet or cup, such as shown in FIGS. 4, 4*a*, 4*b*. In this instance, a cover, such as the cover 31 shown in FIG. 2*a*, is adhesively attached to the planar surface of the lid. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A container lid with a condiment reservoir, said lid defining a planar surface and an outer rim for attachment to the open top of a container, comprising:

an orifice for drinking a liquid in said container extending through said planar surface of said lid and adjacent the outer rim of said lid;

an open top recess forming said reservoir in said lid opposite said orifice, said reservoir extending from the planar surface of said lid to a position lower than said surface; and said recess being formed by closed side walls and a bottom extending down toward said container to form the reservoir, whereby the condiment or a condiment holder may be placed in said reservoir for carrying said condiment for convenient use while held with said container.

2. The container lid of claim 1, wherein said side walls extend at an acute angle from said planar surface to said bottom, said angle being sufficient to allow multiple lids nesting together prior to use.

3. The container lid of claim 1, wherein said side walls of said recess comprise a first substantially semi-circular wall and a second substantially diagonal wall connecting the ends of the first wall to form said reservoir.

4. The container lid of claim 1, wherein said side walls of said recess are substantially circular in cross section to form a cylindrical condiment reservoir.

5. The container lid of claim 1, wherein said condiment holder includes a packet to be carried in said reservoir, the contents of said packet being adapted to be emptied into said reservoir for use.

6. The container lid of claim 1, wherein said condiment holder includes a cup to be carried in said reservoir, the contents of said packet being adapted to be emptied into said reservoir for use.

7. The container lid of claim 1, wherein said orifice is formed by cross slits to receive a straw for a cold drink.

8. The container lid of claim 1, wherein said side walls and said bottom of said recess extend at least partially into said container.

9. The container lid of claim 8, wherein said side walls extend down into said container a sufficient distance so that the reservoir is positioned in ice when an iced cold drink fills said container.

10. The container lid of claim 1, wherein said lid is formed of sufficiently thin plastic to allow outward flexing of said side walls forming said recess;

said condiment holder being a cup; and a first peripheral interlock around said side walls adjacent said bottom wall of said recess;

said first interlock adapted to receive a second mating peripheral interlock of said condiment cup upon flexing of said side walls as the cup is placed in said recess, thereby providing a snap fit to secure said cup in place.

11. The container lid of claim 10, wherein said first interlock comprises a groove and said second interlock comprises a projection substantially mating with said groove as said cup is secured in place.

12. The container lid of claim 1, wherein said side walls of said recess form multiple reservoirs.

13. The container lid of claim 12, wherein said side walls are interconnected to form an open space between the reservoirs.

14. The container lid of claim 13, wherein said side walls form three reservoirs in a triangle pattern.

* * * * *